US007016511B1

(12) United States Patent
Shennib

(10) Patent No.: US 7,016,511 B1
(45) Date of Patent: Mar. 21, 2006

(54) REMOTE MAGNETIC ACTIVATION OF HEARING DEVICES

(75) Inventor: Adnan Shennib, Fremont, CA (US)

(73) Assignee: InSound Medical, Inc., Newark, CA (US)

( * ) Notice: Subject to any disclaimer, the term of this patent is extended or adjusted under 35 U.S.C. 154(b) by 0 days.

(21) Appl. No.: 09/181,533

(22) Filed: Oct. 28, 1998

(51) Int. Cl.
*H04R 25/00* (2006.01)

(52) U.S. Cl. ..... 381/315; 381/328

(58) Field of Classification Search ..... 381/315–323, 381/329; 335/151, 205, 206, 207
See application file for complete search history.

(56) References Cited

U.S. PATENT DOCUMENTS

| | | | | |
|---|---|---|---|---|
| 3,967,224 A | | 6/1976 | Seeley | 335/151 |
| 4,039,985 A | | 8/1977 | Shlesinger, Jr. et al. | 335/153 |
| 4,628,907 A | * | 12/1986 | Epley | 600/25 |
| 4,756,312 A | * | 7/1988 | Epley | 607/57 |
| 4,803,458 A | | 2/1989 | Trine et al. | 338/198 |
| 4,845,755 A | | 7/1989 | Busch et al. | 381/68 |
| 4,918,736 A | | 4/1990 | Bordewijk | 381/68 |
| 4,947,432 A | | 8/1990 | pholm | 381/68.2 |
| 5,128,641 A | | 7/1992 | Posey | 335/151 |
| 5,233,322 A | | 8/1993 | Posey | 335/151 |
| 5,293,523 A | | 3/1994 | Posey | 335/205 |
| 5,303,306 A | | 4/1994 | Brillhart et al. | 381/68 |
| 5,359,321 A | | 10/1994 | Ribic | 340/825.06 |
| 5,553,152 A | | 9/1996 | Newton | 381/68.6 |
| 5,659,621 A | | 8/1997 | Newton | 381/68 |
| 5,796,254 A | | 8/1998 | Andrus | 324/419 |
| 5,811,896 A | * | 9/1998 | Grad | 307/125 |

* cited by examiner

*Primary Examiner*—Sinh Tran
*Assistant Examiner*—Brian Ensey
(74) *Attorney, Agent, or Firm*—Townsend and Townsend and Crew LLP

(57) ABSTRACT

A magnetic switch assembly for hearing devices designed for remote activation by the user is highly miniaturized with a self-contained latching mechanism. The switch is activated and deactivated by the user via a hand-held magnet placed in proximity to the hearing device. The switch assembly includes a miniature reed switch and a miniature latching magnet affixed directly to one of the reeds or the associated lead wire. Direct attachment minimizes the air gap between the latching magnet and a reed thus enabling latching with only an extremely small magnet. The latching magnet produces a magnetic field of adequate strength to hold the reeds together in electrical contact after the air gap between the reeds is closed by the user's placement of the external hand-held magnet in proximity thereto. But the latching magnet's field is of inadequate strength for unaided closure of the air gap between the reeds. Consequently, once the reeds are closed the latching magnet prevents separation thereof until the reeds are exposed to an external magnetic field of opposite polarity and sufficient strength to overcome the field produced by the latching magnet.

24 Claims, 9 Drawing Sheets

REMOTE MAGNETIC ACTIVATION OF HEARING DEVICES

BACKGROUND OF THE INVENTION a. Technical Field

The present invention relates generally to hearing devices, and more particularly to remotely controlled hearing devices which, when worn, are not easily accessible by the hearing impaired user.

b. Description of the Prior Art

Conventional hearing aids are typically equipped with one or more manually operated switches, such as an ON/OFF switch for activating or deactivating the device, or a control switch for adjusting the loudness or frequency response of the device. Improvements are continuously being made in the miniaturization of these controls in order to produce the smallest possible hearing device. Hearing devices are presently available, for example, that are sufficiently small to fit partially in the ear canal (In-The-Canal, or "ITC" devices) or entirely within the canal (Completely-In-the-Canal, or "CIC" devices), collectively referred to herein as "canal devices".

Conventional switches used in hearing devices are electromechanical, with electrical settings that are dependent on mechanical position or movement of the switch. For example, U.S. Pat. No. (USPN) 4,803,458 to Trine et al. discloses a hearing aid miniature switch which is integrated with a potentiometer. Hearing aid switches of the prior art, however, present several problems to manufacturers and users of canal devices. Among the most serious problems presented to manufacturers, for example, is the difficulty of providing designs that allow sufficient space within the hearing device to incorporate a conventional switch along with other key components including the battery necessary to power the device. This problem is particularly frustrating for devices designed to be worn in small or narrow ear canals, but is manageable for the larger hearing devices such as Behind-The-Ear ("BTE") and In-The-Ear ("ITE") types. Therefore, conventional switches are usually limited to these larger hearing devices. Additionally, conventional switches are prone to malfunction and frequent repair because of the susceptibility of their mechanical parts to failure (see, for example, Valente, M., "Hearing Aids: Standards, Options, and Limitations", Thieme Medical Publishers, 1996, p. 239, hereinafter referred to as "Valente").

Among the problems presented to users of heretofore available canal devices are the inaccessibility of and difficulty to manipulate conventional switches, particularly for the geriatric population, which makes remote controlled hearing devices more suited to such users (Valente, p. 240).

Prior art remote control designs for hearing devices typically employ sound, ultrasonic, radio frequency (RF) or infrared (IR) signals for transmission to the device, examples of which are found in U.S. Pat. No. 4,845,755 to Busch et al., U.S. Pat. No. 4,957,432 to T. Pholm, U.S. Pat. No. 5,303,306 to Brillhart et al., and U.S. Pat. No. 4,918,736 to Bordewijk. Such designs typically require additional circuitry to decode the transmitted signal and provide control signals for its internal use, which mandates a need for additional space and power consumption in the device. Availability of space and power, however, are extremely limited in canal devices. Furthermore, operation of buttons or switches typically provided on the remote control unit can present a daunting challenge to users with poor manual dexterity.

Remote control applications which employ reed switches activated by a magnetic field from a proximal magnet are well known, as typified by U.S. Pat. Nos. 3,967,224 to Seeley; U.S. Pat. Nos. 5,128,641, 5,233,322 and 5,293,523 to Posey; and U.S. Pat. No. 5,796,254 to Andrus. These patent disclosures describe various configurations of reed switches which are activated by a control magnetic material—either a permanent magnet or a magnetically permeably material—when placed in proximity to the controlled device. In general, these prior art reed switch remote control designs lack a latching mechanism, and therefore require the continued proximity of the control magnetic material to activate the controlled device. The switch reverts to its normal position immediately upon removal of the control magnetic material from the proximity area.

In prior art hearing aid applications employing a remotely activated reed switch, the switch is typically employed to trigger an input signal for a control circuit within the hearing device. For example, U.S. Pat. No. 5,359,321 to Rubic and U.S. Pat. Nos. 5,553,152 and 5,659,621 to Newton disclose reed switches activated remotely by a magnetic field introduced from a hand-held magnet. The reed switches of these prior art discloses are connected to semiconductor logic or control circuitry and thus indirectly control or switch the parameters of the hearing device. It is well known in the art of semiconductors and circuit design that semiconductor switches can be bulky and require additional control circuitry.

A miniature latching reed switch is ideal for canal devices because no power or control circuitry is required to maintain a particular state. For example, a reed switch can be used to turn off a hearing device by opening the battery circuit, and the off state is then maintained by the switch without consuming any energy from the battery. This is extremely important in long term device applications whereby battery longevity must be maximized.

A latching magnetic reed switch with two modes (positions) is disclosed in U.S. Pat. No. 4,039,985 to Schlesinger, but the switch requires two latching magnets, one for each switch position. A more efficient latching type reed switch shown in FIGS. 1 and 2, manufactured by Hermetic Switch Inc. (model HSR-003DT), has a single magnet bar M mounted externally and perpendicular to the hermetically sealed tubular reed switch R. The ferromagnetic reeds A and B are attached to ferromagnetic lead wires $L_A$ and $L_B$. Because the latching magnet M is relatively large, the switch assembly (SA) is roughly twice the size of the reed switch R alone. The magnet may be made somewhat smaller by the selection of magnet material with higher intrinsic magnetic energy, but the air-gap (AG) between magnet M and either of the reeds (A and B) dictates the need for a substantial magnet size to produce the required latching force.

For canal hearing devices, the prior art latching reed switches referred to above are impractical due to size and configuration considerations. As illustrated in FIG. 3, the human ear canal cavity 30 is generally narrow and elongate. Conventional non-latching miniature reed switches (R) are also narrow and elongate making them ideal for concentric longitudinal placement within the ear canal as shown, but the prior art methods of incorporating one or more reed switches R and latching magnets M (shown with dotted perimeter) mandate a prohibitively large switch assembly (SA), as indicated in FIG. 3. The significance of this size limitation is best understood when considering the need to incorporate other critical components (not shown) within a canal hearing device 70, such as a battery, microphone, amplifier circuitry, speaker, and so forth.

It is a principal objective of the present invention to provide an extremely space efficient latching reed switch assembly for use within a miniature hearing device, particularly a canal device. It is also an objective of the invention to provide an easy to use remote control method, particularly for persons of poor manual dexterity. Other objectives include reliable operation, inexpensive design and elimination of standby electrical power.

SUMMARY OF THE INVENTION

The present invention provides a magnetic switch assembly for hearing devices adapted for remote activation by the user. The magnetic switch assembly is highly miniaturized with a self-contained latching mechanism. User activation is performed by placing a hand-held magnet in proximity to the hearing device. The magnetically latchable switch eliminates conventional miniature electromechanical switches, which are manually controlled and thus not practical for inaccessible hearing devices or for persons of poor dexterity. It also eliminates conventional wireless remote control methods, which require additional circuitry and electrical power.

The switch assembly according to a presently preferred embodiment of the invention comprises a miniature reed switch and a miniature latching magnet affixed directly to one of the reeds or to an electrical lead wire associated with a reed. Direct attachment eliminates air gaps between the latching magnet and a reed, thus enabling latching with an extremely small magnet. The magnet, with its ultra-small size, increases the dimensions of the switch assembly by only a negligible amount.

In the "open" position of the switch assembly, in the absence of an external magnetic field (i.e., unaided), the latching magnet generates a weak attraction force by virtue of its limited magnetic field strength which is insufficient to overcome the air gap between the reeds themselves, i.e., to pull together and close the contacts of the two reeds. However, with the application of an external "on" magnetic field (i.e., suitable proximity, polarity and field strength) from an external control magnet wielded by the wearer (i.e., the user) and placed close to the hearing device, the attraction force becomes sufficient to close the contacts. After assuming to "closed" position, the reed contacts remain closed (latched) under the influence of the latching magnet, even after the removal of the external control magnet. Similarly, the switch contacts can be latchably opened by the application of an external "off" magnetic field from an external control magnet sufficient to overcome the latching force of the latching magnet. Preferably, the control magnet is a hand-held bar with opposite magnetic polarities at its ends, for switching according to the polarity of the end placed proximate to the hearing device.

In the preferred embodiment of the invention, the latching magnet is placed directly on a ferromagnetic lead wire associated with a first reed of a tubular reed switch positioned horizontally in the ear canal. A second ferromagnetic lead wire, associated with a second reed, is positioned laterally to face an activating magnet placed in close proximity to the aperture of the ear canal by the wearer.

The miniature tubular reed switch assembly of the present invention minimally impacts the overall size of the associated hearing device. The sealed switch assembly is more reliable and more conveniently activated than conventional electromechanical switches. It is also more energy efficient and cost effective than prior art wireless switches.

BRIEF DESCRIPTION OF THE DRAWINGS

The above and still further objectives, features, aspects and attendant advantages of the present invention will become apparent from the following detailed description of a preferred embodiment and method of manufacture thereof constituting the best mode presently contemplated of practicing the invention, when taken in conjunction with the accompanying drawings, in which.

DETAILED DESCRIPTION OF THE PRESENTLY PREFERRED EMBODIMENTS AND METHODS OF THE INVENTION

The present invention provides a hearing device that utilizes an ultra miniature switch assembly with unique latching characteristics, remotely activated by a magnet wielded by the wearer. The hearing device is of the canal or implanted device type, so a conventional electromechanical or other switch would not be easily accessible by the wearer. The switch assembly of the invention consists of a miniature reed switch assembly having a pair of reeds within the assembly and a pair of connecting lead wires, and in which a miniature permanent magnet is directly attached either to one of the reeds or to the lead wire associated with the respective reed.

Figure 4:
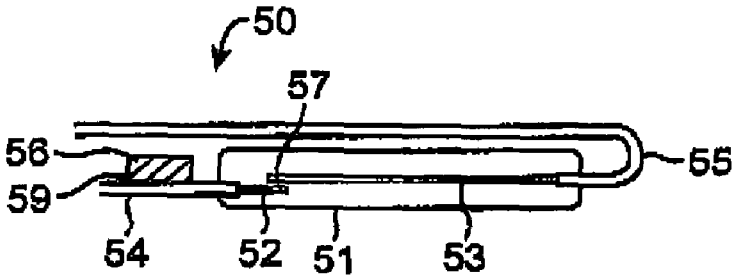
FIG. 4 is a side view of a preferred embodiment of a switch of the present invention, in the open position showing a latching magnet externally positioned and directly on the ferromagnetic lead wire.
Figure 5:
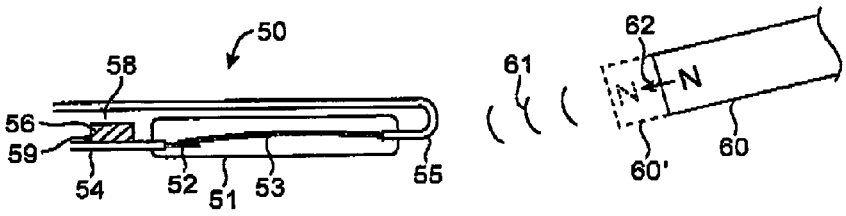
FIG. 5 is a side view of the switch embodiment of FIG. 4 in the closed position, showing the control magnet in proximity to the switch.

In a preferred embodiment, shown in FIG. 4, the magnetic reed switch assembly 50 is tubular and comprises a hermetically sealing glass casing 51 containing a first reed 52 and a relatively more mobile second reed 53. The reeds are made of flexible ferromagnetic material and thus move in response to a magnetic field. The first and second reeds are attached to connecting lead wires 54 and 55, respectively, which are connected to appropriate points of an electrical circuit. The lead wires are preferably also composed of ferromagnetic material, such as nickel-iron alloy, to enhance the sensitivity and response of the connected reeds to a magnetic field applied proximal to either of the lead wires. In the absence of a magnetic field of sufficient strength, the reeds form an air-gap 57 representing an open contact in the normal position. The normal orientation and mechanical properties of the reeds cause the switch to remain in the "open" position (i.e., an open circuit condition, where the electrical circuit in which the reed switch is connected remains non-conductive as long as that condition exists). However, when one of the reeds is exposed to a sufficient magnetic field 61 from an external magnet 60 (FIG. 5), the exposed reed becomes magnetized thus attracting the other reed until a closure of the reed contacts occur. This condition represents the "closed" position of the switch (i.e., a closed circuit condition, where the electrical circuit is then conductive) as shown in FIG. 5, in which second reed 53 makes contact with first reed 52 and air-gap 57 (FIG. 4) is eliminated.

Preferably, the miniature latching magnet 56 is mounted directly to the ferromagnetic first lead wire 54. An adhesive 59 is applied at the edge of the magnet-lead junction to hold the magnet to the lead wire 54. The latching magnet 56 produces a magnetic field and, thereby, a force of attraction between reeds 52 and 53. This attraction force alone, however, is intentionally insufficient to close the reed contacts, and hence, the switch remains latched in the "open" position. However, in the presence of a magnetic field 61 produced by a proximate control magnet 60 of appropriate orientation and polarity (60'), the attraction force between the reeds will increase, causing a closure of the contacts and the electrical circuit associated with lead wires 54 and 55. The "closed" condition, shown in FIG. 5, occurs when the control magnet 60 is moved to position 60' in the direction of arrow 62 and towards second lead wire 55. In the closed position, the air-gap 57 (FIG. 4) between the reeds is eliminated which increases the flux density and the attraction force between the contact reeds. The elimination of the air-gap 57 in the closed position and the magnetic field strength of the latching magnet 56 enables the magnet to maintain closure of the switch even after the removal of the external control magnet 60. Reversing the switch to the normal open position is achieved simply by reversing the polarity of the control magnet 60 and placing it similarly within proximity of second lead wire 55 (condition not shown) to overcome the latching force of the latching magnet 56, whereupon the reed contacts will undergo separation from one another.

Figure 6:
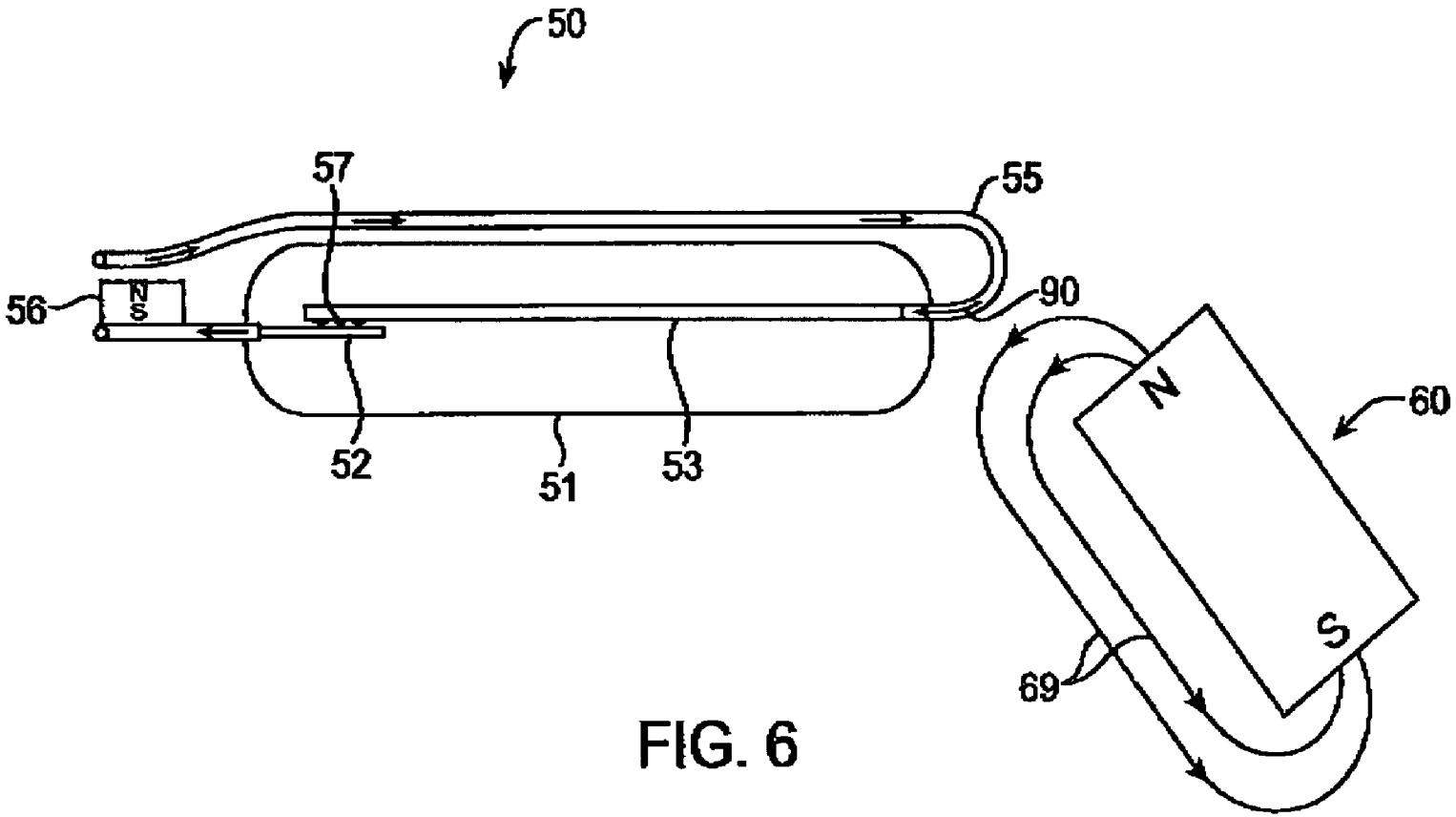
FIG. 6 is a side view of the switch embodiment of FIG. 4 in the open position, showing magnetic flux lines within the reed switch and from a control magnet placed in proximity thereto.

FIG. 6 shows the effect of magnetic flux lines 69 from a control magnet 60 on the reed switch assembly 50. Flux lines within the reed switch assembly (shown by arrow 90) are partially caused by latching magnet 56 and are enhanced to cause closure by flux lines 69 from control magnet 60. The latching magnet 56 is magnetically polarized across (N and S as shown) in order to cause a flux circuit 90 within the reed switch assembly as shown.

The magnet type, size, shape, orientation with respect to the reed switch, and other characteristics are designed such that a latching closure force only occurs upon the substantial reduction of the air-gap 57 between the reeds. Once the reed contacts are opened by an external magnetic force and an air-gap 57 develops in between, the attraction force caused by the latching magnet alone is not sufficient to overcome the mechanical bias force of the reeds towards the open position.

The significance of the present invention in terms of size and weight reduction and simplicity of use will be demonstrated presently herein with reference to Examples 1 and 2 below.

The latching magnet 56 is preferably composed of rare-earth material such as Neodymium Iron Boron (NdFeB) or Samarium Cobalt (SmCo). These magnets are known for their high energy properties, and are typically coated with nickel, gold, aluminum, or other material to prevent corrosion and deterioration of magnetic energy.

Figure 7:
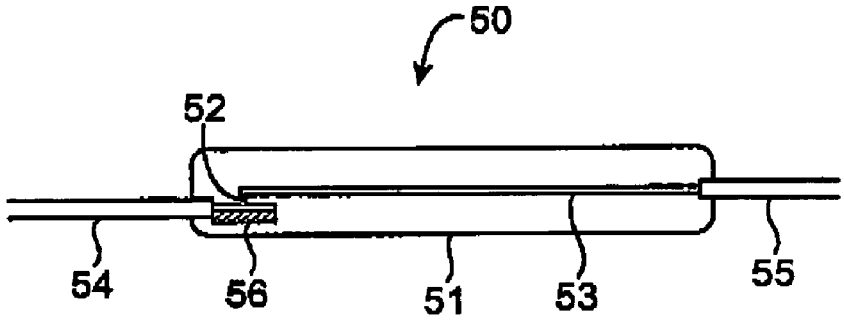
FIG. 7 is a side view of an alternative embodiment of the reed switch of the invention, with latching magnet internal to the casing and directly affixed to one of the reeds.

In another embodiment of the invention, shown in FIG. 7, the latching magnet 56 is attached to a first reed 52 within casing 51. This configuration provides several advantages including further size reduction of the magnet 56 due to its direct contact with the reed and elimination of coating requirement due to the hermetic sealing effect.

Figure 8:
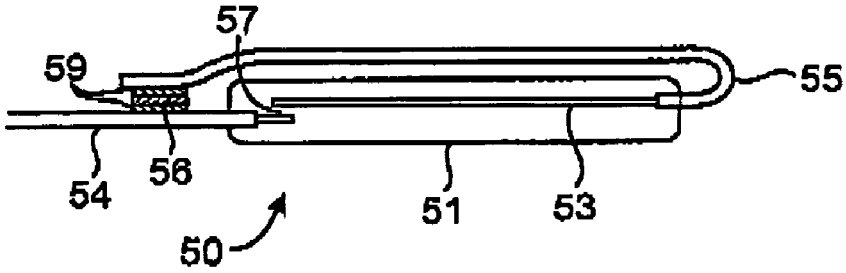
FIG. 8 is a side view of another embodiment of the reed switch, in which a magnet is adhesively wedged between the two lead wires of the reeds of the switch.

In yet another embodiment, shown in FIG. 8, the latching magnet 56 is wedged in between the two ferromagnetic lead wires with thin layers of adhesive 59 (top and bottom) holding the magnet in place.

Regardless of the configuration or embodiment of the present invention, the spacing between the latching magnet 56 and the underlying ferromagnetic contact must be essentially eliminated in order to achieve the improved efficiency. However, a miniscule spacing, not exceeding approximately 0.2 mm, is permissible since it produces negligible adverse effect on the performance of the switch assembly. This spacing may be caused by a thin layer of magnet coating (not shown) or a layer of adhesive as shown in FIG. 8.

Figure 9:
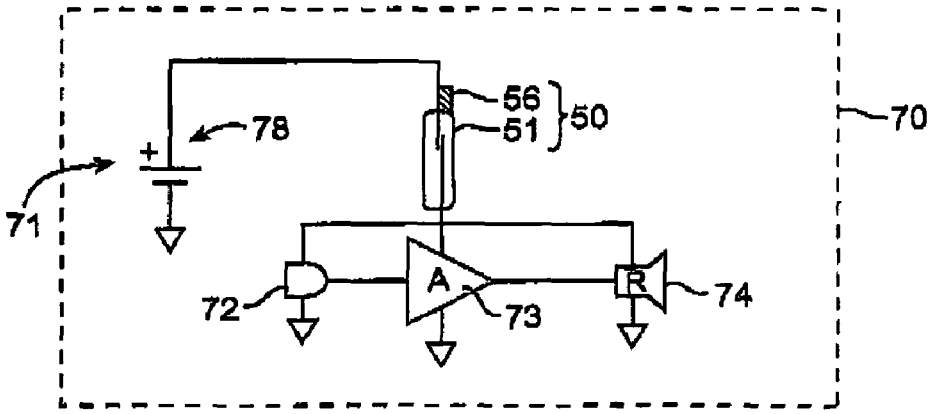
FIG. 9 is a schematic representation of the latching reed switch assembly of the invention, used as a power switch (ON/OFF) in a hearing device.

An ideal application of the present invention is in remote power switching (ON/OFF) of inaccessible hearing devices. A simplified schematic of this example application is shown in FIG. 9. The reed switch assembly 50 connects and disconnects power terminal 78 from battery 71 to any active electrical or electroacoustic component such as amplifier 73, microphone 72 or receiver (speaker) 74. Once the switch assembly is remotely turned off, the current drain from the battery is completely shut off and no stand-by current is consumed while the hearing device is in the off position. This energy efficient feature of the present invention is critical for long-term-use applications of canal or implant hearing devices.

Figure 10:
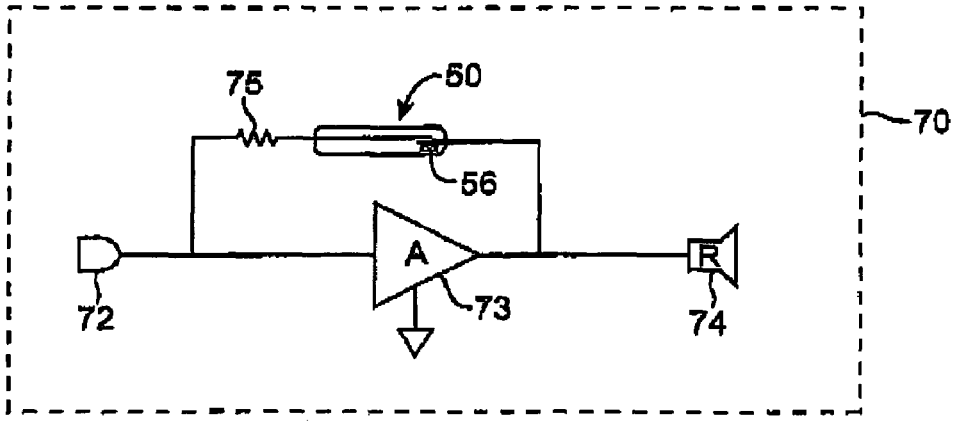
FIG. 10 is a schematic representation of the latching reed switch assembly of the invention, used as a volume control switch in a hearing device.

Another application of the present invention is in device adjustment such as volume, frequency response or other control or operating parameter. A simplified schematic of a volume control switch, for example, is shown in FIG. 10. The reed switch assembly 50 inserts, on demand by the user, a feedback resistance 75 in the feedback pathway of amplifier 73 (input impedance not shown, for the sake of simplicity). This reduces the amplification, thus altering the volume setting of the hearing device 70.

Figure 11:
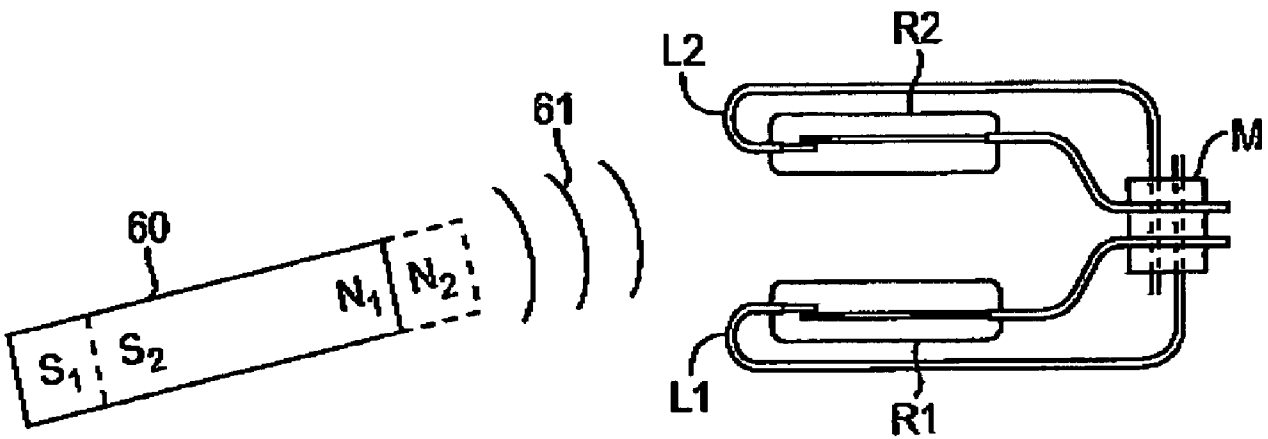
FIG. 11 is a side view of a dual switch configuration showing individual switch action according to the proximity of a control magnet.

Two or more switches of the present invention may be combined in the same hearing device to control two or more settings—for example, power and volume settings. FIG. 11 shows a dual switch assembly with a single shared latching magnet M. The reed switches R1 and R2 are configured with lead wires L1 and L2 extended to different lengths as shown. Lead wire L1 being closer to the control magnet 60 causes switch R1 to be activated prior to switch R2. This provides a position sensitive control for each of the two settings. For example, when the north pole of the control magnet 62 reaches position N1, R1 switch responds and activates (turns ON) the hearing device. As the control magnet 60 further approaches the dual switch, R2 switch is subsequently activated and an increase in the volume (or change in frequency response, depending on switch application) occurs.

Figure 12:
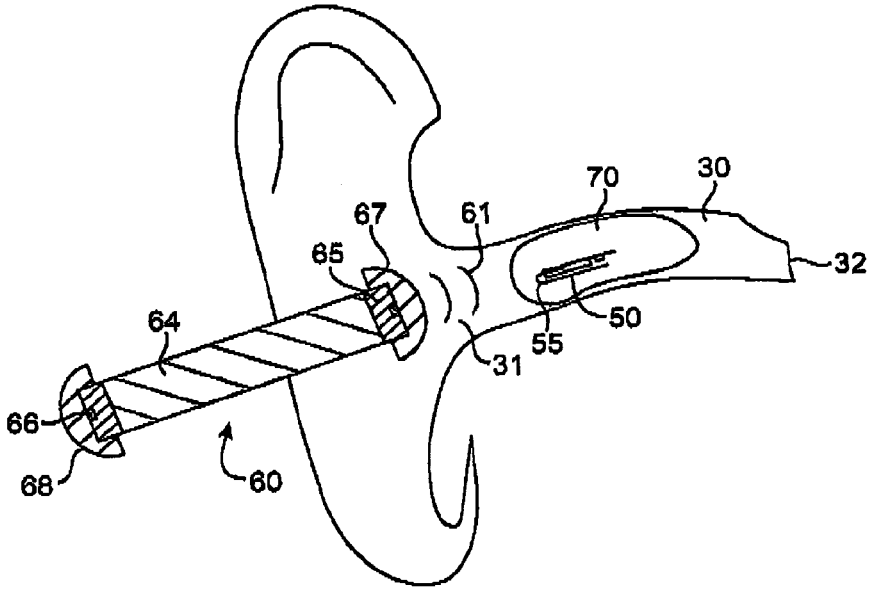
FIG. 12 is a side view of the reed switch assembly of the invention in a canal hearing device, with a control magnet in proximity thereto.

FIG. 12 shows an application of the present invention in a canal hearing device. The hearing device 70 is fully inserted in the ear canal 30 terminating medially by the tympanic membrane 32 (eardrum). The switch assembly 50 is part of a canal device 70 with lead wire 55 laterally positioned facing the magnetic field 61 emanating from a control magnet 60. The bar-shaped control magnet 60 has two magnets 65 and 66 with opposing magnetic polarities (N and S) on each end. The control magnet may be equally effective with a single bar magnet.

Stopper flanges, 67 and 68, are optionally placed on each end of the control magnet 64 to prevent it from entering the ear canal and possibly touching or pushing the canal device 70.

The control magnet of the present invention preferably incorporates permanent magnets (e.g., magnetic poles of opposite polarity at opposite ends of a bar magnet). However, a magnetic field may be generated by other means known in the art such as by an electromagnet (not shown) comprising a coil, a battery and a switch.

Figure 13:
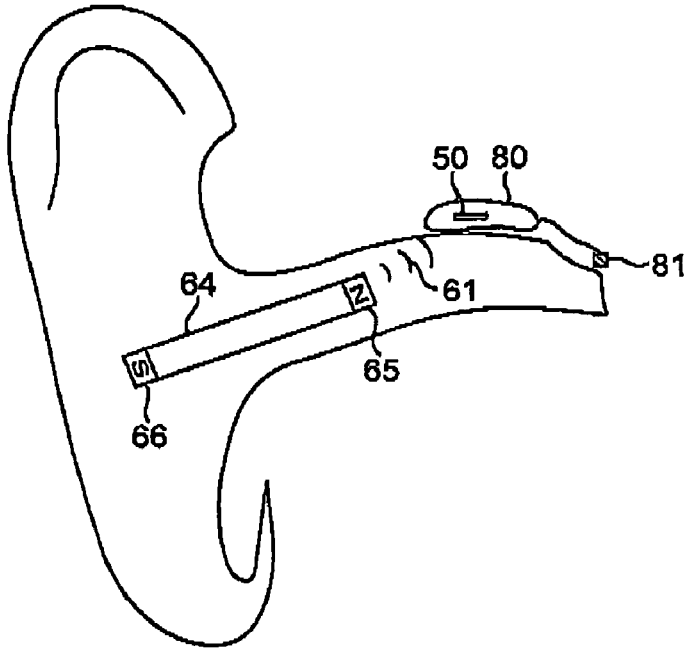
FIG. 13 is a side view of the reed switch assembly of the invention in an implanted hearing device, with a control magnet inserted in the ear canal in close proximity to the hearing device.

The latching reed switch assembly of the present invention is suitable for any body-worn hearing or audio device that is not readily accessible by the wearer. In implant applications, as shown in FIG. 13 for example, a hearing device 80 is surgically implanted with a vibrating transducer 81 placed on a vibratory structure (not shown) of the middle or inner ear. The implanted hearing device 80 is remotely activated by a control magnet 64 placed in the ear canal by the user.

Two examples of reed switch assemblies fabricated according to the invention will now be described.

EXAMPLE 1

Figure 1:
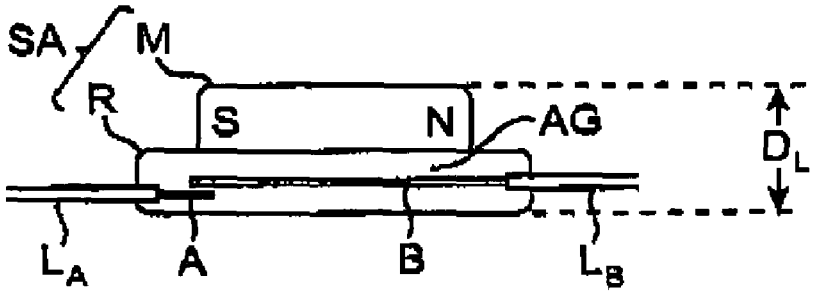
FIG. 1 is a fragmentary side view of a latching reed switch assembly of the prior art, discussed above, in which a latching magnet is positioned along the length of the reed switch with an air-gap therebetween.
Figure 2:
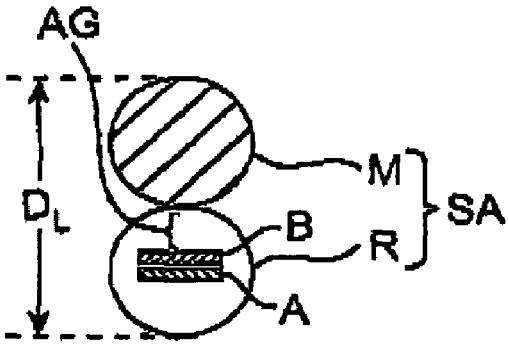
FIG. 2 is a cross-sectional view of the latching reed switch assembly of FIG. 1, discussed above.
Figure 3:
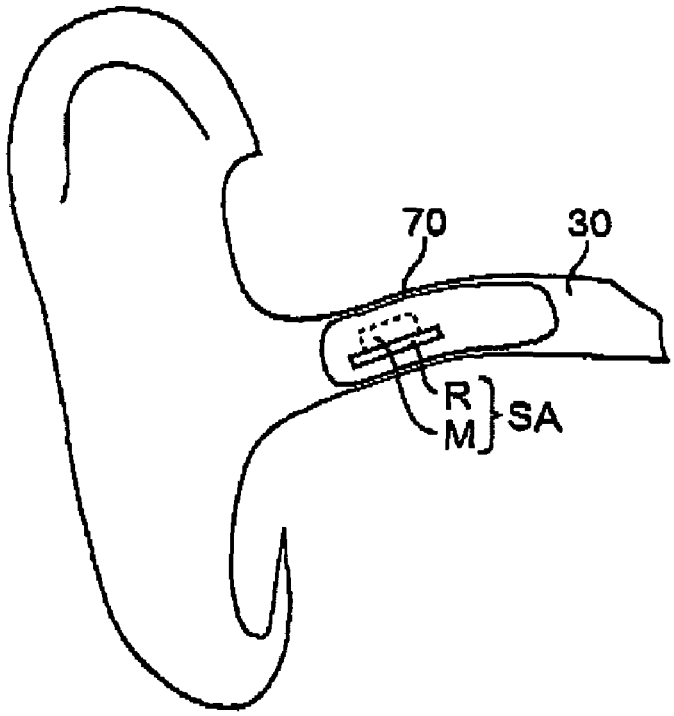
FIG. 3 is a transparent partial side view of a prior art reed switch assembly in a canal hearing device, discussed above, positioned within a human ear canal.

A latching reed switch assembly according to a preferred configuration of the present invention, shown in FIGS. 4–6, was constructed and compared to the prior art switch configuration shown in FIG. 1. The prior art latching reed switch assembly was based on micro-miniature reed switch model HRS-003DT manufactured by Hermetic Switch, Inc. of Chickasha, Okla. The prior art switch assembly included a latching magnet rod (M) constructed of Alnico material and positioned along the length of the tubular reed switch shown in FIG. 1. The magnet M was approximately 4.1 mm long and 1.8 mm in diameter, with a volume of approximately 10.4 $mm^3$. The weight of the magnet was measured to be approximately 74 mg. The reed switch was approximately 5 mm long and 1.25 mm in diameter, with a volume of approximately 6.1 $mm^3$. The reed switch weighed approximately 17 mg with a total of 11 mm of the lead wire attached. The combined volume and weight of the prior art reed switch assembly were approximately 16.5 $mm^3$ and 91 mg, respectively. The cross sectional long diameter ($D_L$, FIG. 2) of the assembly was 3.05 mm.

The embodiment of the present invention shown in FIGS. 4–6 was fabricated using the same reed switch (model HSR-003DT) but with an ultra miniature magnet 56 placed directly on lead wire 54. The magnet, weighing approximately 1.7 mg, was made of Neodymium Iron Boron (NdFeB), a rare-earth magnet which, as noted above, is known for its high magnetic energy (energy product). The miniature magnet was shaped as a thin slab approximately 1 $mm_3$ L×0.62 mm W and 0.38 mm H with volume of 0.24 $mm^3$ (vs. 10.4 $mm^3$ in prior art designs). The combined volume and weight of the example magnet were approximately 6.3 $mm^3$ and 18.7 mg, respectively. Since the latching magnet 56 is placed on lead wire 54 and its height is only 0.38 mm, the cross sectional diameter of the switch assembly of the present invention is essentially that of the reed switch casing 51. The magnet was aluminum plated to prevent corrosion of the magnetic material. The distant end 57 of the second lead wire 55 was bent and brought close facing the top of magnet 56 and creating an external gap 58 as shown in FIGS. 4 and 6. Minimizing the external gap 58 (FIG. 5) increases the magnetic flux density, thus producing a latching force with even a smaller latching magnet 56.

The correct position of the latching magnet 56 on the lead wire was empirically determined by first placing the latching magnet approximately 5 mm way from edge of the casing 51. The latching magnet 56 was then gradually glided on the lead wire towards the first reed 52 until the reed contacts closed. The latching magnet was then moved away approximately ⅓ mm. This ensured a magnetic attraction between the reeds just below the threshold of closure in the open position. The latching magnet 56 was then attached to the lead wire 54 by a careful application of an adhesive (Loctite 4014). The latching magnet position was approximately 1 mm away from the glass casing 51. The reed switch assembly was then potted with silicone rubber for environmental and handling protection.

A summary comparison between the prior art switch assembly and the switch assembly of the present invention is shown in Table 1 below.

TABLE 1

| | Prior Art Switch (FIG. 1) | Present Invention Switch (FIG. 5) |
|---|---|---|
| Assembly Volume | 16.5 mm | 6.3 mm |
| Assembly Weight | 91 mg | 18.7 mg |
| Magnet Weight | 74 mg | 1.7 mg |
| Cross Section Long Diameter | 3.05 mm | 1.25 mm |

As indicated in Table 1 above, the magnetic switch assembly of the present invention is considerably more efficient than prior art switches in terms of weight, size and configuration for incorporation into a miniature canal hearing device.

EXAMPLE 2

A control magnet was fabricated to control the latching reed switch assembly described in Example 1 above. The control magnet 60 shown in FIG. 12 was in the shape of a cylindrical rod having a length of 4.3 cm and a diameter of 5.3 mm. The body 64 of the rod was made of plastic and is attached to a pair of identical disk magnets 65 and 66. The two magnets were polarized across the length of the rod and were oriented to have opposing magnetic polarity as shown in FIG. 6. The disk magnets were made of NdFeB material sold by Radio Shack (model no. 64-1895). Each disk magnet was approximately 4.3 mm in diameter and 1.5 mm in height.

The control magnet also had two flanged stoppers (67 and 68), designed to prevent the control magnet from entering the ear canal and accidentally pushing or touching any of the components of the canal hearing device 70. Each stopper was made of polyurethane foam material but, alternatively, may be composed of any other suitable material such as plastic, silicone or silicone rubber.

The function of the control magnet of the above example was tested in conjunction with the latching reed switch assembly described in Example 1. It was found that effective and reliable latching occurred when either end of control magnet (65 or 66) was positioned approximately 15 mm from the switch assembly 50. This distance is considered ideal since it places the control magnet within the vicinity of the canal aperture 31 as shown in FIG. 12.

From the foregoing description, it will be understood that the invention provides a hearing device adapted to be positioned in the ear canal of a wearer (or alternatively, to be surgically implanted adjacent to the ear canal), which includes electrical circuit means for receiving and processing incoming signals representative of audio signals and converting them to an output for exciting a vibratory structure of the ear of the wearer such as the tympanic membrane, so as to reproduce the processed audio signals therefrom; a magnetically controlled latchable reed switch assembly for controlling at least one of activation and deactivation of the hearing device, or an operating parameter such as volume control or frequency response. The reed switch assembly includes a reed switch including first and second reeds providing electrical contacts spaced apart by an air gap, respective lead wires electrically connected to the first and second reeds and to the electrical circuit means, and a latching magnet directly affixed to either the first reed or to the lead wire associated with the first reed. The latching magnet has a magnetic field of sufficient strength to maintain the first and second reeds together in electrical contact after the air gap is eliminated by an externally applied magnetic field of suitable magnitude, polarity and proximity, but of insufficient strength to bring the first and second reeds together in electrical contact while the air gap exists.

The hearing device of the invention may have the latching magnet directly affixed to one of the reeds, but in the preferred embodiment each of the lead wires is ferromagnetic and the latching magnet is directly affixed to one of the ferromagnetic lead wires. Alternatively, the latching magnet may be wedged between the ferromagnetic lead wires. The reed switch assembly would typically be a power switch for activation and deactivation of the hearing device, but alternatively or additionally, it may be connected so as to control an operating parameter of the device such as loudness of the output signal that provides the vibratory excitation to enhance the wearer's hearing, or the frequency response of the hearing device.

Although a presently contemplated best mode of practicing the invention has been described herein, it will be recognized by those skilled in the art to which the invention pertains from a consideration of the foregoing description of a presently preferred embodiment, that variations and modifications of this exemplary embodiment and method may be made without departing from the true spirit and scope of the invention. Thus, the foregoing embodiments of the invention should not be viewed as exhaustive or as limiting the invention to the precise configurations disclosed. Rather, it is intended that the invention shall be limited only by the appended claims and the rules and principles of applicable law.

What is claimed is:

1. A miniature hearing device adapted to be positioned substantially in the ear canal of a wearer, said device comprising:

electrical circuit means for receiving and processing incoming signals representative of audio signals and converting them to an output for exciting the tympanic membrane of the wearer;

a miniature magnetically controller miniature latchable reed switch assembly for controlling at least one of activation and deactivation of the hearing device or an operating parameter of the hearing device, said miniature reed switch assembly including:

a reed switch including first and second reeds providing electrical contacts spaced apart by an air gap, respective lead wires electrically connected to said first and second reeds and to said electrical circuit means; and a latching magnet directly affixed to one of said first reed or the lead wire associated with said first reed, said latching magnet having a magnetic field of sufficient strength to maintain said first and second reeds together in electrical contact after said air gap is closed by an externally applied magnetic field of suitable magnitude, polarity and proximity, but of insufficient strength to bring said first and second reeds together in electrical contact while said air gap exists, wherein the externally applied magnetic field is generated by a magnetic field means that is substantially located outside of the ear canal or substantially physically disengaged with the hearing device the field means effecting actuation of the reed switch when the field means is at a first orientation with respect to the reed switch and when the field means is at a second orientation with respect to the reed switch.

2. The hearing device of claim 1, wherein said latching magnet is directly affixed to said first reed.

3. The hearing device of claim 1, wherein each of said lead wires is ferromagnetic.

4. The hearing device of claim 1, wherein said latching magnet is directly affixed to said ferromagnetic lead wire connected to said first reed.

5. The hearing device of claim 3, wherein said latching magnet is wedged between said ferromagnetic lead wires.

6. The hearing device of claim 1, wherein said reed switch is encapsulated in a hermetically sealed casing.

7. The hearing device of claim 1, wherein said reed switch assembly is positioned for remote control by a control magnet wielded by the wearer.

8. The hearing device of claim 7, including a control magnet supplied with said device and including means to prevent insertion of said control magnet into the ear canal.

9. The hearing device of claim 8, wherein said control magnet is an electromagnet.

10. The hearing device of claim 1, wherein said reed switch assembly is a power switch for activation and deactivation of said hearing device.

11. The hearing device of claim 10, wherein said reed switch assembly is connected to additionally control an operating parameter of the device.

12. The hearing device of claim 11, wherein said reed switch assembly comprises a plurality of reed switches.

13. The hearing device of claim 1, wherein said latching magnet has a protective coating.

14. The hearing device of claim 1, wherein said reed switch assembly is protectively potted.

15. A miniature hearing device adapted to fit within or to be surgically implanted adjacent to the ear canal of a human user and to be remotely controlled for powering the device on and off and/or for adjusting an operating parameter of the device to enhance the hearing of the user in response to a received incoming signal to the device representative of an audio signal, said device comprising:

a magnetically controlled miniature latchable reed switch assembly to enable the user to remotely control the device by use of an external magnet, said reed switch assembly including:

a reed switch having at least a pair of reeds spaced apart by an air gap; and a latching magnet directly affixed to one of said reeds or to a lead wire associated therewith for holding said reeds together in electrical contact after being closed by the user's passage of said external magnet in proximity thereto, but of inadequate magnetic field strength to close said air gap without aid; whereby once said reeds are closed, the latching magnet prevents separation thereof until said reeds are exposed to an external magnetic field of sufficient strength and opposite polarity to the field of said latching magnet, wherein the external magnet is substantially located outside of the ear canal or substantially physically disengaged with the hearing device, the external magnet effecting actuation of the reed switch when the external magnetic is at a first orientation with respect to the reed switch and when the external magnetic is at a second orientation with respect to the reed switch.

16. The hearing device of claim 15, wherein said magnetically controlled latchable reed switch assembly controls at least one of activation deactivation of the device and device operating parameters including adjustment of frequency response of the device to said received incoming signal representative of an audio signal and adjustment of loudness of the processed received incoming signal as output vibrations of said hearing device to a vibratory structure of the ear of the user.

17. The hearing device of claim 15, further including electrical circuit means for processing the received incoming signal, and ferromagnetic lead wires connected to each reed, respectively, and to predetermined points of the electrical circuit means.

18. The hearing device of claim 16, wherein said reed switch assembly includes at least one additional reed switch having at least a pair of reeds spaced apart by an air gap, the first mentioned and additional reed switches being positioned for concurrent control of activation of the device and adjustment of one of said operating parameters.

19. A method of remotely activating and deactivating a miniature hearing device, the method comprising:

implementing the hearing device with a miniature magnetically controlled miniature latchable reed switch assembly to apply and remove battery power to the device including a reed switch having at least a pair of reeds spaced apart by an air gap and a latching magnet directly affixed to one of said reeds or to a lead wire associated therewith for holding said reeds together once closed by an external magnetic field of appropriate magnitude and polarity, but the latching magnet itself having inadequate magnetic field strength for unaided closure of said reeds spaced apart by said air gap;

providing a control magnet means capable of generating a magnetic field of said appropriate magnitude for use by the wearer by placement in close proximity to said miniature reed switch assembly (i) with one polarity when the hearing device is to be activated by closing said /s to apply battery power to the device, so that the latching magnet prevents said reeds from being subsequently separated, and (ii) with the opposite polarity when the hearing device is to be deactivated by overcoming the latching force of the latching magnet and opening said reeds to remove battery power to the device; and activating the reed switch with the control magnet means substantially physically disengaged from the hearing device, the read switch being actuable when the control means is in a first orientation with respect to the reed switch and when the control means is in a second orientation with respect to the reed switch.

20. The method of claim 19, further comprising fashioning the control magnet means to fit near the opening of the ear for convenience of use by the wearer when the control magnet means is to be placed in close proximity to said reed switch assembly, but with a stopper to prevent the control magnet means from entering the ear canal.

21. The method of claim 19, further comprising: fabricating the control magnet means in the form of a bar magnet having opposite polarities at its ends so that the control magnet means is conveniently inverted and placed near the ear by the wearer for powering the device on and off.

22. The method of claim 19, further comprising: implementing said magnetically controlled latchable reed switch assembly with an additional pair of reeds spaced apart by an air gap, to enable remote control of the loudness of the output of the hearing device by use of said control magnet means by the wearer.

23. The method of claim 19, further comprising: implementing said magnetically controlled latchable reed switch assembly with an additional pair of reeds spaced apart by an air gap, to enable remote control of the frequency response of the hearing device to received incoming signals representative of audio signals by use of said control magnet means by the wearer.

24. A miniature hearing device adapted to be positioned substantially in the ear canal of a wearer, said device comprising:

electrical magnet means for receiving and processing incoming signals representative of audio signals and converting them to an output for exciting the tympanic membrane of the wearer;

a miniature magnetically controlled miniature latchable reed switch assembly for controlling at least one of activation and deactivation of the hearing device or an operating parameter of the hearing device, said miniature reed switch assembly including:

a reed switch including first and second reeds providing electrical contacts spaced apart by an air gap, respective lead wires electrically connected to said first and second reeds and to said electrical circuit means; and a latching magnet directly affixed to one of said first reed or the lead wire associated with said first reed, said latching magnet having a magnetic field of sufficient strength to maintain said first and second reeds together in electrical contact after said air gap is closed by an externally applied magnetic field of suitable magnitude, polarity and proximity, but of insufficient strength to bring said first and second reeds together in electrical contact while said air gap exists; and wherein the reed switch is configured to be activated in the ear by the externally applied magnetic field when the external magnetic field is applied at variable directions with respect to a longitudinal axis of the reed switch and a pole end of a magnet generating the external magnetic field is positioned at an aperture of the ear canal, the generating magnet physically disengaged from the hearing device.

* * * * *